United States Patent [19]

Viegener

[11] Patent Number: 4,852,192

[45] Date of Patent: Aug. 1, 1989

[54] FAUCET ASSEMBLY PLUMBING FIXTURE

[76] Inventor: Rodolfo J. Viegener, Uriarte Street No. 1534, Buenos Aires, Argentina

[21] Appl. No.: 11,527

[22] Filed: Feb. 6, 1987

[30] Foreign Application Priority Data

Feb. 7, 1985 [AR] Argentina ..... 303082

[51] Int. Cl.[4] ..... E03C 1/00; E03C 1/04

[52] U.S. Cl. ..... 4/191; 4/192

[58] Field of Search ..... 4/191, 192, 194, 197; 137/359, 360; 285/132, 161, 193, 194, 192

[56] References Cited

U.S. PATENT DOCUMENTS 3,868,967 3/1975 Harding ..... 4/192 X 4,387,738 6/1983 Bisonaya et al. ..... 4/194 X 4,463,460 8/1984 Arnold et al. ..... 4/191

4,538,646 9/1985 Yang ..... 4/192 X

*Primary Examiner*—Henry K. Artis

*Attorney, Agent, or Firm*—John Remon Wenzel

[57] ABSTRACT

An improved faucet assembly plumbing fixture including a spigot with a depending tubular plunger, a holder with an open base telescopically fitted over the lower end of the plunger, and a headed screw threaded fastener inserted through the holder base and threaded into the plunger to assemble the parts together. The holder may be tubular or solid. The fastener head is thus located near or below the sink bottom basin so as to be easily accessable to mount a faucet assembly on a sink.

6 Claims, 4 Drawing Sheets

FAUCET ASSEMBLY PLUMBING FIXTURE

BACKGROUND OF THE INVENTION

This invention concerns otherwise conventional faucet assemblies for lavatory or kitchen sinks and the like and, more specifically, to an improved plumbing fixture to facilitate installation of the faucet assembly.

Conventional faucet assemblies may include a separate hot and cold water valves, each having a base stem inserted through an opening in the rear flange of a sink or the faucet assembly may be a single fixture including two base stems mounted through openings in the rear flange of the sink. Whether the faucet assembly has one base stem or two, such a conventional stem is externally threaded to receive a nut and thus securely mount the fixture in place.

This conventional construction presents a number of difficulties. First, the space between the sink basin rear wall and a wall of the kitchen or lavatory in which the sink is installed is usually extremely small, making it very difficult to secure the nut on the faucet assembly base stem without having a special tool to accomplish the task. Secondly, such conventional faucet assembly base stems have external threads which can be easily damaged during assembly. Furthermore, even before assembly, such base stem external threads need to be protected in order not to be damaged. Thirdly, conventional assembly of a nut to a faucet assembly often causes the faucet assembly to rotate as it is being secured in place, thus further complicating the mounting process.

The present invention provides a plumbing fixture for mounting faucet assemblies which overcomes these disadvantages. The faucet assembly may be mounted without need of entering the small space between a sink basin rear wall and the wall of the kitchen or lavatory in which the sink is installed. The parts may be assembled without any possibility of rotating the faucet assembly in its mounting. Instead of a base stem, the faucet assembly is provided with a lower tubular plunger having screw threads only in its interior and thus the member will not be damaged. The present invention also provides a plumbing fixture including a slip fit joint or connection between parts so as to accommodate a considerable range of thickness in the sink flange in which the faucet assembly is mounted.

SUMMARY OF THE INVENTION

It is a principal object of the invention to provide an improved faucet assembly plumbing fixture including a connector or fastening element which is easily accessible.

It is another object of the invention to provide an improved faucet assembly plumbings fixture including telescopically slidable fitted parts adjustable over a considerable dimensional range, for example, of from 10 mm to 40 mm.

It is yet another object of the invention to provide an improved faucet assembly plumbing fixture having no externally threaded parts that can be damaged before or during installation.

It is still a further object of the invention to provide an improved faucet assembly plumbing fixture wherein the otherwise conventional faucet assembly may be easily mounted without the possibility of the assembly being rotated during mounting.

Still another object of the invention is to provide an improved faucet assembly plumbing fixture which may include one or two feed passages at the lower end thereof.

Another object of the invention is to provide an improved faucet assembly plumbing fixture which is uncomplicated in construction and low in cost of manufacture.

BRIEF DESCRIPTION OF THE DRAWINGS

Further and more complete objects and advantages of the invention will become readily apparent by reference to the following specification and drawings in which.

DESCRIPTION OF THE PREFERRED EMBODIMENTS

Figure 1:
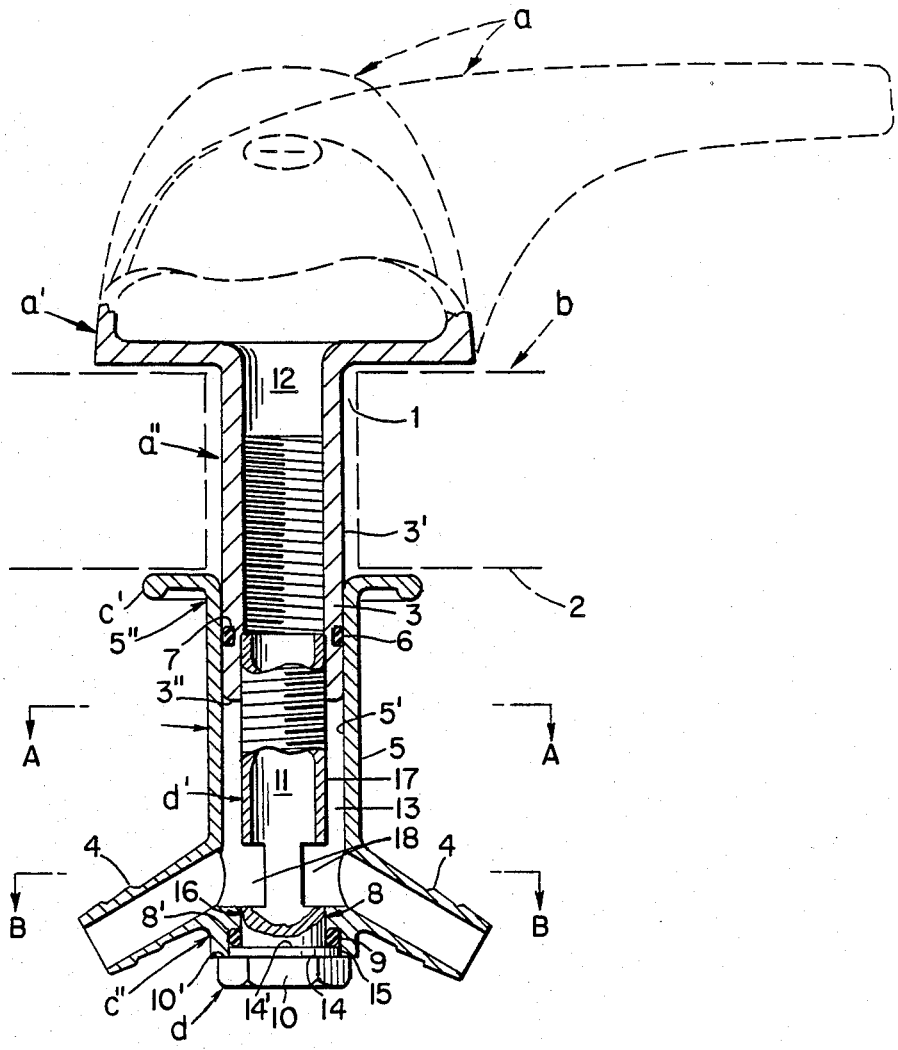
FIG. 1 is an elevation, section view of one embodiment of the invention.
Figure 2:
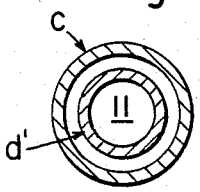
FIG. 2 is a section view taken along Lines A—A of FIG. 1.
Figure 3:
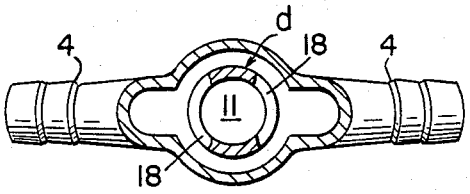
FIG. 3 is a cross-section view taken along Lines B—B of FIG. 1.

Referring now to the drawings by reference character and particularly to FIGS. 1–4 thereof, reference letter a is conventional and identifies a spigot or handle and spigot assembly, depending on the particular installation. In any event, this part of the structure is otherwise completely conventional.

Beneath member a is an upper spigot outlet a′ which includes a lower, tubular plunger a″ which extends downwardly through and extends from an orifice 1 formed through the flange structure of a sink b. Such flange structures b may include the sink flange only or may include both the sink flange and an underlying counter structure. In any event, this structure is otherwise completely conventional. Plunger a″ protrudes through the bottom 2 of sink flange b and terminates in an end portion 3. An adjustable tubular holder element c is telescopically, slidably fitted over plunger end portion 3. The external cylindrical surface 3′ of end portion 3 and the mating, inside cylindrical surface 5′ of holder element c are smooth along their entire lengths. A sliding, sealed relationship between the parts is assured by a sealing ring 6, which may be an O ring, mounted within a channel 7 formed within the external surface 3′ of end portion 3.

The wall 5 of holder element c has an upper end 5″ which terminates in peripheral collar c′ which is clamped against the undersurface or bottom 2 of sink flange b in a manner to be explained hereinbelow.

The bottom of plunger a″ terminates in an open end 3″. The bottom of holder element c includes one or two lateral inlet feed passages 4,4. Each of these inlets 4 may be connected, if desired, to an otherwise conventional faucet valve (not shown).

Figure 4:
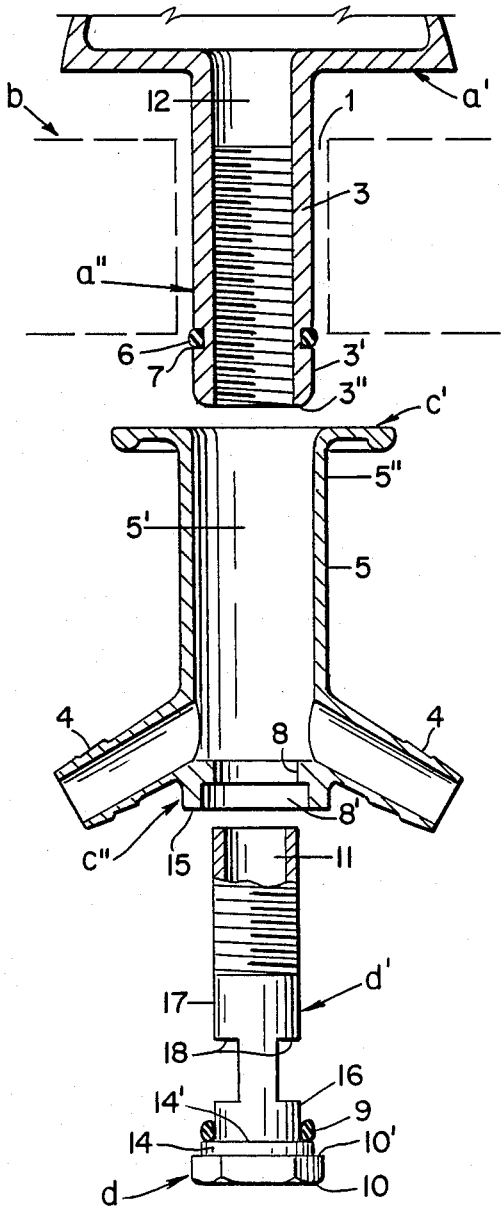
FIG. 4 is an exploded section view of the embodiment of the invention shown in FIG. 1.

At the bottom of holder element c is defined a lower base opening 8 through which is inserted a headed, screw threaded fastener means d. In this embodiment, the upper end d′ of fastener d is externally threaded. The internal surface of holder element c is provided mating threads as is shown in FIGS. 1 and 4. Thus, holder element c is threaded to lower tubular plunger a″ by fastener 10 in order to secure all of the parts in assembly and thus mount the faucet assembly.

The head 10 of fastener d has an upper surface 10′ which seats against the lower end c″ of lower base opening 8. An annular ring 14 is located above surface 10′ and presents an annular surface 14′ upon which is seated an annular packing ring 9. In assembly, packing ring 9 seats against a surface 8′ of opening 8. The very lower, terminal end of the bottom seat of base opening 8 is identified by reference numeral 15 and this part seats against surface 10′ of head 10 of threaded fastener d. Above surface 8′ is formed an annular ring 16. A clearance space between upper end d′ of fastener d and the inside surface 5′ of holder element c is identified at 13 in FIG. 1.

Fluid communication from the inlet feed passages 4,4 and the spigot or spigot and handle assembly a is readily apparent from an inspection of FIG. 1. Fluid enters from passages 4,4 to inlet ports 18,18 formed in the lower portion 17 of upper end d′ of threaded fastener d, within which is defined a central, tubular passageway 11 which, in turn, is an open communication with the interior 12 of tubular plunger a′ which, finally, leads to the spigot or spigot and handle assembly a of the plumbing fixture.

Figure 5A:
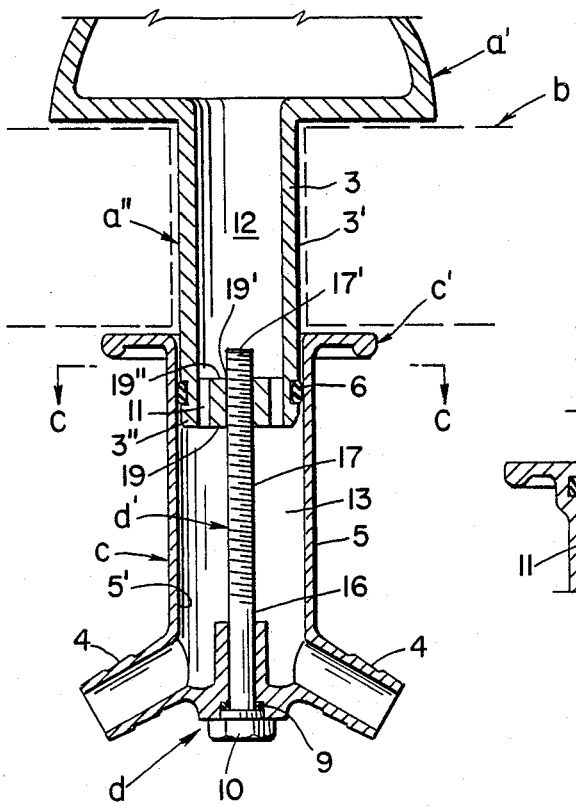
FIG. 5*a* is an elevation, section view of a second embodiment of the invention and includes an insert, section view, FIG. 5*b* of a central portion of the embodiment of the invention drawn to an enlarged scale.
Figure 5B:
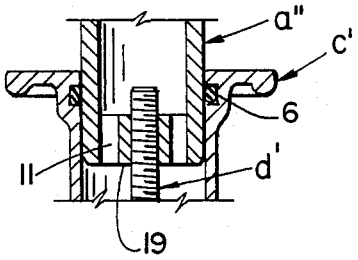
Figure 6:
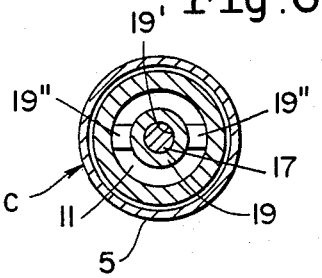
FIG. 6 is a section view taken along Lines C—C of FIG. 5.
Figure 7:
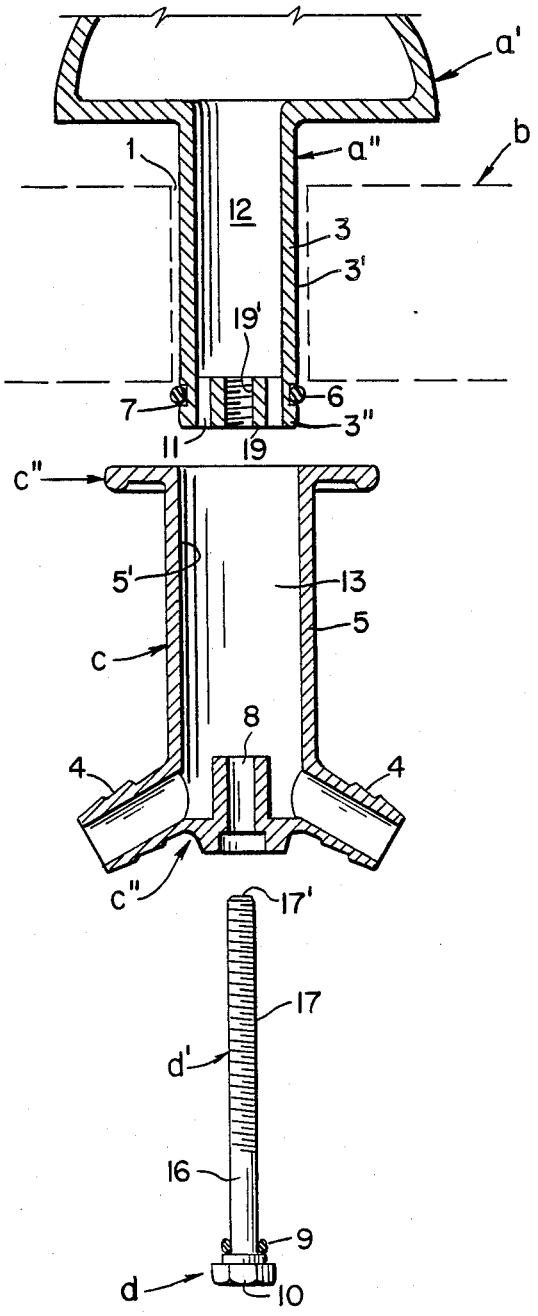
FIG. 7 is an exploded, section view of the embodiment of the invention shown in FIG. 5.

Turning now to FIGS. 5–7, a second embodiment of the invention is illustrated which is rather similar to the first embodiment of the invention except that the upper end d′ of threaded fastener d is solid rather than tubular. The lower end of the tubular plunger a″ includes a spider assembly 19 mounted therewithin having a central, threaded aperture or opening 19′ which receives the threaded, upper end 17′ of threaded fastener upper end d′. Spider 19 includes radial partitions 19″ which define conduits or passageways 11 which establish fluid communication between the holder element c and the tubular plunger a″, as is readily apparent from an inspection of FIG. 5.

Clearly, modifications may be made to the invention and thus the scope of the invention is defined by the following, appended claims.

I claim:

1. An improved faucet assembly plumbing fixture to facilitate installation of a faucet assembly in lavatory or kitchen sinks and the like, the sink including a conventional flange and at least one conventional orifice therethrough for mounting of the faucet assembly, the plumbing fixture comprising: an upper spigot outlet; a lower, tubular plunger depending from the spigot outlet, the plunger being inserted through the sink flange orifice and protruding therebelow; an adjustable tubular holder element means telescopically slidably fitted over said tubular plunger for tightly clamping the plunger and holder together against the upper and lower surfaces of the sink flange adjacent the orifice, said holder having at least one lateral feed passage means thereinto, said holder further including means defining a lower, open base therein; circular seal means inserted between the plunger and holder at a predetermined location whereby the plunger and holder may be slidably adjusted to accommodate varying thicknesses of sink flanges yet maintain a fluid tight sealed relationship therebetween; said holder including an upper peripheral collar seated against the sink flange lower surface adjacent the orifice; headed, screw threaded means extended through said holder open lower base in sealed relationship therewith, said headed screw threaded means including first screw threads formed about at least the upper end thereof, said lower tubular plunger including second screw threads means formed therein mating with said first screw threads whereby, in assembly of the plumbing fixture, said headed screw thread means is threadably engaged with the plunger second screw thread means thus to draw said outlet and plunger, holder and head screw thread means together; and means defining a fluid conduit from said lateral feed passage means upwardly to said upper spigot outlet.

2. The improved faucet assembly plumbing fixture as claimed in claim 1 wherein said plunger includes a lower, open end, said circular seal means being an O ring seal; and means defining an O ring seal seat about the lower open end of the plunger.

3. The improved faucet assembly plumbing fixture as claimed in claim 1 wherein said headed screwthread means includes a head member seated in the holder open lower base, there being fluid tight seal means between said head member and the open lower base, said headed screw threaded means upper end being dimensioned so as to define an open, annular fluid passage way between the interior wall of said tubular holder and said headed screw threaded means upper end.

4. The improved faucet assembly plumbing fixture as claimed in claim 3 wherein said headed screw threaded means upper end is tubular in construction, thus to define a hollow interior therewithin; there further being means defining at least one port through the side wall of said headed screw threaded means upper end which is in fluid communication with said lateral feed passage.

5. The improved faucet assembly plumbing fixture as claimed in claim 3 wherein said screw threaded means upper end is solid, said lower tubular plunger including a spider assembly therein having a central opening with said second screw thread means defined centrally therewithin, said spider including at least one conduit formed therethrough, outwardly of said spider central opening, thus to establish a fluid passage from the interior of the holder to the interior of the lower tubular plunger.

6. The improved faucet assembly plumbing fixture as claimed in claim 1 wherein said lateral feed passage means are at least two in number and arranged opposite one another in the lower end of said holder.

* * * * *